United States Patent [19]

Leyendecker

[11] 4,366,026

[45] Dec. 28, 1982

[54] PROCESS FOR THE PRODUCTION OF COKE OR SEMICOKE

[75] Inventor: Gustave Leyendecker, St-Avold, France

[73] Assignee: Hoilleres du Bassin de Larraine, Freyming Merlebach, France

[21] Appl. No.: 312,079

[22] Filed: Oct. 16, 1981

Related U.S. Application Data

[63] Continuation of Ser. No. 162,244, Jun. 23, 1980, abandoned.

[30] Foreign Application Priority Data

Jun. 25, 1979 [FR] France ..... 79 16233

[51] Int. Cl.[3] ..... C10B 27/00; C10B 49/06; C10B 57/14

[52] U.S. Cl. ..... 201/1; 201/22; 201/28; 201/33; 201/35; 201/38; 201/39

[58] Field of Search ..... 201/22, 33, 38, 1, 15, 201/27, 28, 35, 36, 37, 39

[56] References Cited

U.S. PATENT DOCUMENTS 1,830,884 11/1931 Nielson et al.
3,940,239 2/1976 Rossi et al.
4,038,153 7/1977 Dervelle et al.
4,064,018 12/1977 Choi ..... 201/22

FOREIGN PATENT DOCUMENTS 417688 8/1925 Fed. Rep. of Germany .
1201247 12/1959 France .
2295382 7/1976 France .

OTHER PUBLICATIONS

Perry, Chem. Engr. Handbook, 4th Ed., McGraw-Hill, ch. 20, pp. 26 & 27, 1963.

*Primary Examiner*—Bradley Garris
*Attorney, Agent, or Firm*—Cushman, Darby & Cushman

[57] ABSTRACT

In the continuous production of coke or semicoke from coal grains and/or fines an inclined, air-tight rotating tubular oven is fed with coal grains and/or fines from a hopper. As the coal grains and/or fines progress down the rotating oven they are heated by a stoichiometric mixture from a burner and converted into coke or semicoke having a volatile content of from 1% to 20%. During the heating of the coal grains and/or fines the interior of the oven is maintained under a slightly elevated pressure in relation to the atmosphere. The coke or semicoke is then extracted from the oven and passed to an extinguishing device where the coke or semicoke is extinguished to prevent recombustion.

9 Claims, 1 Drawing Figure

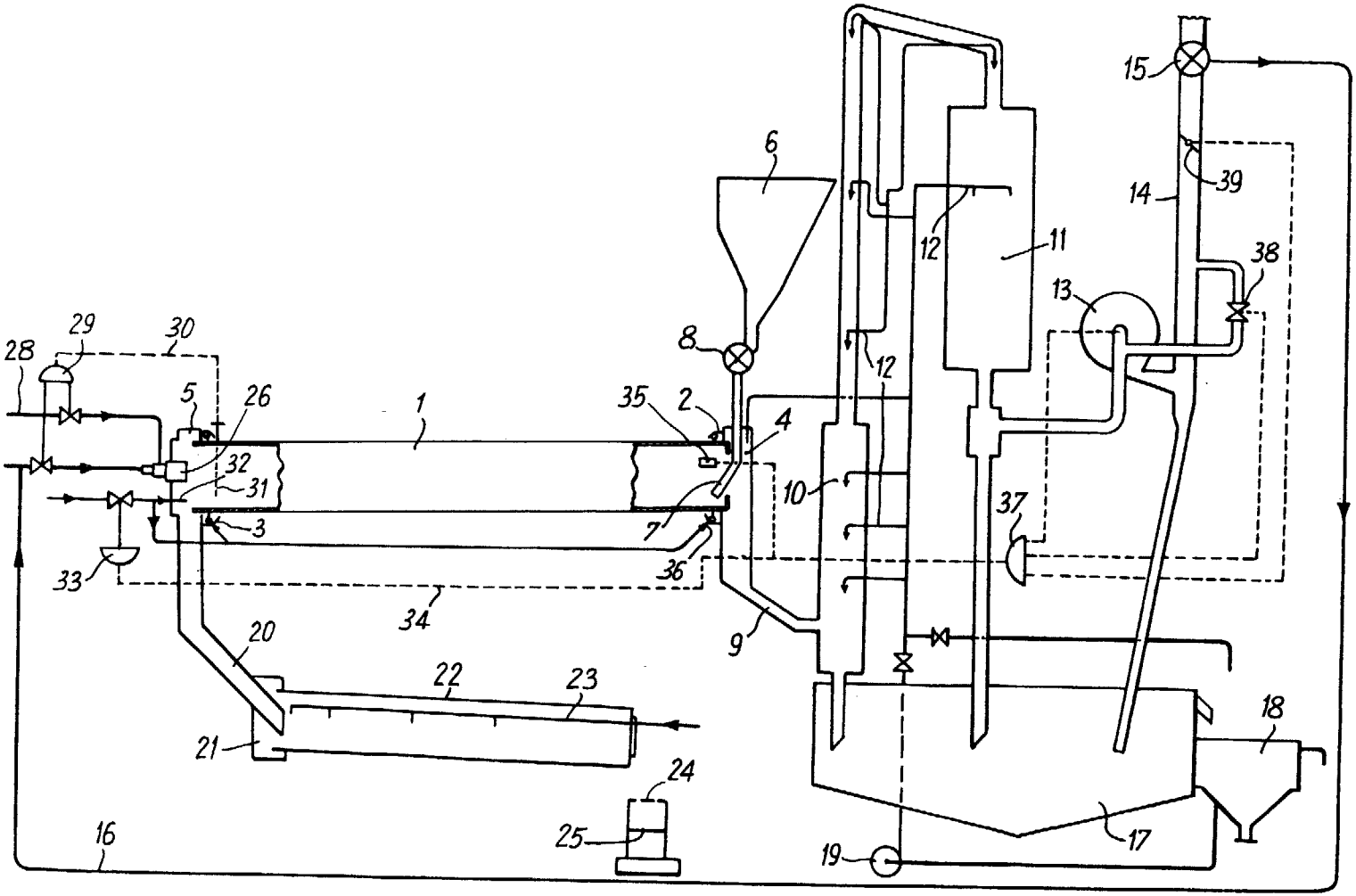
1
2
3
4
5
6
7
8
9
10
11
12
12
13
14
15
16
17
18
19
20
21
22
23
24
25
26
28
29
30
31
32
33
34
35
36
37
38
39

PROCESS FOR THE PRODUCTION OF COKE OR SEMICOKE

This is a continuation of application Ser. No. 162,244 filed June 23, 1980, now abandoned.

BACKGROUND OF THE INVENTION

The present invention relates to a process for the continuous production of coke or semicoke by means of a rotary oven and to an apparatus for producing coke or semicoke.

In U.S. Pat. No. 4,038,153 a process is described for the production of a reactive coke, which is fairly well fired and in which the volatile materials are used for producing in situ the heat necessary for carbonization, while the sensible heat of the smoke and also the residual combustible gases are used for generating steam. Such a process is practically autothermic and in practice provides a coke containing from 1 to 8% of volatile materials.

This process is effective for obtaining more or less reactive cokes having a low content of volatile materials, but, unless considerably modified, does not make it possible to obtain cokes or semicokes fired at a relatively low temperature, for example below 600° C., and still having a fairly high content of volatile materials, for example up to 20%.

Such cokes or semicokes may have numerous direct or indirect applications. They may be used without further treatment for electrometallurgy, electrochemistry, and gasification. They may serve as added material in the production of moulded coke or in carbonised coke pastes in charging processes involving preheating and/or compaction.

An object of the present invention is to obtain, with good flexibility of regulation, a wide range of cokes differing in respect of contents of volatile materials, for example in the range from 1 to 20% of volatile materials. Another object is to avoid the combustion of by-products in situ, with a view to recovering the maximum amount of tars and gases.

SUMMARY OF THE INVENTION

According to the present invention there is provided a process for continuously producing a product comprising one of coke and semicoke having from 1% to 20% of volatile constituents from material comprising at least one of coal grains and fines containing more than 15% of volatile constituents and having a swelling number lower than 8, the process comprising:

(a) providing a rotatable tubular oven which has an upstream end and a downstream end and which is slightly inclined downwards from the upstream end to the downstream end, (b) introducing the material into the upstream end of the oven, (c) permitting the material to progress from the upstream end to the downstream end of the oven, (d) supplying heat from a hot gas generator to the downstream end of the oven, (e) regulating the hot gas generator to produce one of neutral and reducing hot gases, and (f) extracting the product from the downstream end of the oven, the improvement comprising injecting an auxiliary ballast fluid into the oven to provide a slightly elevated pressure in relation to the atmosphere pressure outside the oven.

Also according to the present invention there is provided an apparatus for continuously producing a product comprising one of coke and semicoke having from 1% to 20% of volatile constituents from material comprising at least one of coal grains and fines containing more than 15% of volatile constituents and having a swelling number lower than 8, the process comprising:

(a) a rotatable tubular oven which is substantially fluid-tight and has an upstream end and a downstream end and which is slightly inclined downwardly from the upstream end to the downstream end, (b) substantially fluid-tight means provided at the upstream end for introducing the material, (c) fluid-tight means for the extraction of gas from the oven, (d) means provided at the downstream end of the oven for one of introduction and generation of hot gases, (e) substantially fluid-tight means for extracting the product from the oven, (f) a product extinction device having an inlet connected to the extraction means, (g) steam introduction means for the oven, (h) a gas pressure detector for detecting gas pressure within the oven, and (i) means to regulate the introduction of steam into the oven in dependence on the gas pressure detected by the gas pressure detector.

The hot gas generator may for example be a burner installed at the end of the rotatable oven.

By dispensing with partial in situ combustion of the coal, the by-products, particularly the tars, are preserved. While avoiding the presence of any oxidising gas, the elevated pressure also contributes towards protecting the by-products from degradation. The application of this elevated pressure entails the provision of good sealing, particularly for the joints of the rotatable oven. Feeding and heating hoods may be provided at each end of the oven and labyrinth seal may be provided for the heating and feed hoods in order to prevent the discharge of tarry gases to the outside.

In order to achieve regulation to the desired carbonization temperature, for example to a set point temperature between 450° and 1100° C., the calorific output of the hot gas generator may be controlled by the difference between the temperature of the coke or semicoke at the end of the oven and a set point heating temperature. In this way carbonization is effected at the set point temperature, thus indirectly making it possible to obtain the desired content of volatile constituents. Control of the carbonization temperature is essential.

The elevated pressure inside the oven may be regulated by a valve situated upstream of a production gas exhaust fan. Finer regulation may be obtained in addition by injecting an auxiliary ballast fluid, such as water vapour and/or the combustion smokes of the recycled lean gas from the carbonization, and/or nitrogen, directly into the rotatable oven.

The coke or semicoke may be extinguished by introduction into an inclined rotating tube provided with water atomizers, and the coke or semicoke extinguished immediately after its extraction from the rotary oven. Since the process results in the production of highly reinflammable semicokes, depending on the regulation, the immediate extinction of these semicokes may be important.

In order to reduce the formation of agglutinated balls of coke, a recycled portion of the finest fraction of the cokes or semicokes obtained may be added to the fines and/or grains in the carbonization of caking coals. By thus reducing the formation of such balls, the reinflammation of the semicoke is avoided, because these balls are difficult to extinguish to the core.

The extinction device may comprise water spraying means furthermore the extinction device may be an inclined rotatable tube having an open discharge end.

BRIEF DESCRIPTION OF DRAWING

An embodiment of the present invention will now be described by way of example and with reference to the accompanying drawing, the single FIGURE of which shows an apparatus for continuously producing coke or semicoke from coal grains and/or fines.

DESCRIPTION OF PREFERRED EMBODIMENT

A rotary tubular oven 1 is fluid-tight and inclined 2° to the horizontal downwardly, from right to left in the drawing. At its ends the rotary oven is in communication by means of rotary joints 2 and 3 of the labyrinth seal type with, respectively, a feed hood 4 and a heating hood 5. A feed hopper 6 enables coal to be fed upstream of the oven by means of an inclined spout 7 and with the aid of a compartmented dispenser 8. Hot gasses of the rotary oven are extracted from the feed hood 4, whose walls are rinsed with water in order to avoid any fouling, through a pipe 9 carrying them to a first scrubber 10, from which they pass to a second scrubber 11, batteries of water sprays 12 being disposed in the said scrubbers. At the outlet of the scrubber 11 the gases are drawn in by an exhaust fan 13 and delivered to a pipe 14 provided with a valve 15 enabling all or part of these gases to be delivered to a storage vessel and/or to a recycling pipe 16. The gas washing waters are passed to a decanter 17 in communication with an overflow tank 18, from which a pump 19 recycles them to the sprays 12.

On the downstream side of the oven the heating hood 5 leads into a spout 20 leading directly into a hood 21 of a rotary extinction tube 22 which is inclined at 2° downwards from left to right in the drawing. This tube 22 is equipped with a bank 23 of water sprays. The tube 22 is open at its lower or downstream end, and the coke extinguished in the tube can fall onto a screen 24, the material passing through which falls onto a conveyor belt 25.

The rotary oven 1 is heated by means of a burner 26 fed through a pipe with liquid or gaseous fuel and through an air pipe 28. A regulator 29 ensures stoichiometric regulation of the proportions of fuel and air or, if desired, a reduced supply of air. The flow of fuel is also controlled by the regulator 29 under the control of a circuit 30 in accordance with a set point temperature which must be respected in the mass of incandescent coke or semicoke, the true temperature being measured therein by a thermometric probe 31 disposed in the oven, near the hood 5. Water vapour can also be introduced into the oven through a tube 32 leading into the hood 5. The flow of water vapour can be regulated by a pressurestat 33 controlled by a circuit 34 in accordance with a set point pressure which must be respected in the actual oven space, the true pressure being measured by a pressure detector 35 disposed in the oven, for example at an upstream point.

The hot gases recycled through the pipe 16 may be reintroduced into the burner 26 either directly or mixed with the fuel supplied through the pipe, if this fuel is in gaseous form.

The tightness of the oven is achieved by injecting water vapour, by means of injectors 36, into the rotary joints 2 and 3.

The pressure detector 35 serves to control, by means of a logic circuit 37, the pressure drop produced by the exhaust fan 13; this logic circuit may also open or close a by-pass valve 38 and/or control a draught damper 39.

The apparatus operates in the following manner.

The coal is supplied to the carbonization oven through the hopper 6, which is provided with a protective sieve, and through the anti-jamming compartmented dispenser 8. This arrangement makes it possible to supply the installation independently of the speed of rotation and of the slope of the rotary oven 1.

In passing through the carbonization oven 1, the coal loses its volatile constituents because of the calories supplied by the stoichiometrically operating burner 26.

The rotary carbonization oven 1 works with a slight elevated pressure (~10 Pa) in order to prevent the entry of parasitic air which could degrade the quality of the gas produced, by dilution or by combustion of the volatile materials. The labyrinth seals 2 and 3 and steam injection joint 36 with which the heating and feed hoods of the oven are equipped thus prevent the discharge to the outside of tarry gases. Steam injection ducts make it possible, if desired, to increase the pressure artificially.

A slight leakage flow occurs between the rotary carbonization oven 1 and the incandescent coke extinction tube 22.

The coke flows freely between the tubes 1 and 2; the difference in pressure between the carbonization tube 1 and the extinction tube 2 is lower than 10 Pa. A hot coke guard also makes it possible to limit return flows.

Control of pressure and also measurement and regulation of temperature in the carbonization oven 1 are effected as previously described.

By way of the spout 20, which is of ample dimensions and adequately inclined to prevent any accidental jamming by agglomerated material, the incandescent coke flows into the extinction tube 22, where the coke is extinguished by spraying with water. Extinction is assisted by natural air flow through the extinction tube through the effect of the air drawn in by the atomisers. It is in fact known that in order to obtain good extinction of a semicoke it is advantageous for the semicoke to fix a sufficient amount of oxygen in the course of its cooling.

As previously stated, the production gas passes into the feed hood 4, the walls of which are rinsed with water in order to avoid any fouling, and then into a series of scrubbers 10, 11, in which it undergoes spraying. Almost all the tars are thus trapped and recovered at the bottom in the decanter 17.

In normal operation there are practically no floating tars in the decanter 17 and at the same time an only slightly damp and only slightly dusty sinking tar is obtained.

In order to obtain the best possible quality of tar, it is advantageous to control the residence time of the volatile materials in the oven so as to avoid their thermal dissociation. This result is achieved by means of water vapour serving as ballast gas in the oven and by the appropriate scrubbing system for the production gases which makes it possible to prevent fouling. It is also achieved through the recycling of the smokes which form a ballast.

The means of the invention therefore make it possible to control the carbonization temperature, which is of capital importance because of the well known risk of running out of control in the production of semicoke or reactive coke.

A Table now follows which shows the experimental conditions of the invention for a Wendel I-II coal, with and without recycling of the finest fraction of the cokes obtained.

| | Without recycling | With recycling |
|---|---|---|
| Particle size | 12-18 | 12-18 |
| Swelling number | 5 | 5 |
| Volatile constituents/dry % | 38.3 | 38.3 |
| Flow of wet coal, kg/h | 328 | 312 |
| including recycled fines 0-4 | — | 31 |
| Speed of rotation fo oven, r.p.m. | 3 | 3 |
| Outlet temperature of coke, °C. | 622 | 607 |
| Pressure in heating hood (Pa) | +3 | +6 |
| Ballast gas | steam | none |
| Production of coke: | | |
| Output (kg/h) | 240 | 239 |
| Humidity of coke, % | 9.6 | 6.7 |
| Volatile constituents of coke, % | 11.8 | 11.6 |
| Ash content of coke, % | 8.9 | 10.8 |
| Output of "balls⇄ (>60 mm) | 28.3 kg/h (11.8%) | 7.9 kg/h (3.3%) |
| Particle size of material <60 mm | | |
| <40 mm | 87.6% | 92.2% |
| <20 mm | 64.3% | 56.6% |
| <10 mm | 25.5% | 20.6% |
| <5 mm | 17.4% | 13.6% |
| <2 mm | 10.3% | 7.4% |

It is thus seen that recycling leads to a reduction of "balls" (3.3% against 11.8%) and to a reduction of "fines" (13.6% of 0-5 against 17.4%).

I claim:

1. In a process for continuously producing a coke or semicoke product having from 1% to 20% of volatile constituents therein from coal grains, coal fines or mixtures of grains and fines containing more than 15% of volatile constituents therein and having a swelling number less than 8, said process comprising:

(a) providing a rotatable tubular oven which has an upstream end and a downstream end and which is slightly inclined downwards from the upstream end to the downsteam end, (b) introducing the coal grains and/or fines into the upstream end of the oven while rotating the tubular oven, (c) permitting the material to progress from the upstream end to the downstream end of the oven, (d) supplying heat from a hot gas generator to the downstream end of the oven, (e) regulating the hot gas generator to produce either stoichiometric neutral or reducing hot gases, (f) extracting the coke or semicoke product from the downstream end of the oven, and (g) exhausting the production gas and other carbonization by-products by means of an exhaust fan, the improvement consisting essentially, in combination, of:

(1) controlling the rate of pressure reduction produced by the exhaust fan means in accordance with pressure conditions inside the oven, and (2) injecting into the tubular oven an auxiliary ballast fluid to maintain a slightly elevated positive pressure in the oven in relation to the atmospheric pressure outside the oven.

2. A process for the continuous production of a coke or semicoke product having from 1% up to 20% of volatile constituents contained therein, said process comprising the steps of:

(1) providing a rotatable tubular oven having an upstream end and a downstream end, the tubular oven being inclined downwards from the upstream end to the downstream end;

(2) providing means for introducing coal grains and/or coal fines into the oven, means for collecting the coke product so produced and exhaust fan means for removing gaseous carbonization products from the oven;

(3) rotating said tubular oven;

(4) introducing coal grains and/or coal fines for conversion into coke or a semicoke product into the upstream end of said oven, the coal grains, coal fines or mixtures of grain and fines having a swelling number below 8 and containing more than 15% volatile constituents therein;

(5) permitting the coal grains and/or coal fines to progress from the upstream end to the downstream end of the oven during rotation;

(6) supplying a stoichiometric amount of heat from a hot gas generator to the downstream end of the oven while regulating the output of the hot gas generator to produce a predetermined carbonization temperature in the range of about 450° C. to about 1100° C. in the oven while regulating the hot gas generator in accordance with the temperature of the coke or semicoke product discharged from the downstream end of the oven;

(7) controlling the rate of pressure drop produced in the tubular oven by the exhaust fan means;

(8) injecting a water vapor or other inert gas as an auxiliary ballast fluid into the oven in combination with controlling the rate of pressure drop in step (7) and thereby providing a positive pressure inside the oven which pressure is slightly above that of the atmosphere surrounding the oven;

(9) removing the thus produced coke or semicoke product from the downstream end of the oven, and

(10) removing hot gases and volatile constituents produced during the carbonization by exhaust fan means while maintaining a positive pressure in the oven.

3. The process according to claim 1 or 2 wherein the auxiliary ballast fluid comprises water vapor.

4. A process according to claim 1 or 2 wherein the oven is provided with joints and wherein a neutral gaseous fluid is injected into the joints to impede leakage at the joints.

5. The process according to claim 1 wherein the process is operated at a predetermined heating temperature between about 450° C. and about 1100° C., wherein the calorific output of the hot gas generator is controlled by the difference between the temperature of the product at the downstream end of the oven and the predetermined heating temperature.

6. The process according to claim 2 wherein the calorific output of the hot gas generator is controlled by the difference between the temperature of the product at the downstream end of the oven and the predetermined heating temperature.

7. The process according to claim 1 comprising the additional steps of providing an inclined rotating tube, introducing the product from the oven into the inclined rotating tube, providing the rotating tube with water atomizers, and extinguishing the product in the rotating tube immediately after its extraction from the oven.

8. The process according to claim 2 wherein the thus produced coke or semicoke product is extinguished immediately after its extraction from the oven following step (9).

9. The process according to claim 1 or 2 wherein the finest fraction of the coke or semicoke product is recycled back into the oven together with the introduced coal fines and/or grains.

* * * * *